US005644907A

United States Patent [19]

Kolmes et al.

[11] Patent Number: 5,644,907

[45] Date of Patent: Jul. 8, 1997

[54] CUT RESISTANT YARN AND PROTECTIVE GARMENT MADE THEREFROM

[76] Inventors: Nathaniel H. Kolmes, 204 Timberwood La., Rte. 10, Hickory, N.C. 28601; Harold F. Plemmons, Rte. 1, Box 628, Millers Creek, N.C. 28651

[21] Appl. No.: 176,075

[22] Filed: Mar. 31, 1988

Related U.S. Application Data

[63] Continuation of Ser. No. 766,846, Aug. 16, 1985, abandoned.

[51] Int. Cl.[6] ..... D02G 3/12

[52] U.S. Cl. ..... 57/230; 57/212

[58] Field of Search ..... 57/901, 230, 212, 57/210

[56] References Cited

U.S. PATENT DOCUMENTS

| | | | |
|---|---|---|---|
| 3,288,175 | 11/1966 | Valko | 139/425 R |
| 3,315,455 | 4/1967 | Stoller | 57/231 X |
| 3,323,301 | 6/1967 | Jackson | 57/230 X |
| 4,470,251 | 9/1984 | Bettcher | 2/161 R |

FOREIGN PATENT DOCUMENTS

| | | | |
|---|---|---|---|
| 0886740 | 1/1962 | United Kingdom | 57/230 |

*Primary Examiner*—Daniel P. Stodola
*Attorney, Agent, or Firm*—Dorsey & Whitney LLP

[57] ABSTRACT

A protective garment such as glove, apron, sleeve or the like, knitted from at least one end of yarn, the yarn having a core and covering, the core having at least two strands and the covering having at least one strand. The core includes a polyolefin fiber and may include a wire strand. The covering may be polyolefin or nylon.

12 Claims, 1 Drawing Sheet

CUT RESISTANT YARN AND PROTECTIVE GARMENT MADE THEREFROM

This is a continuation of application Ser. No. 06/766,846, filed Aug. 16, 1985, now abandoned.

BACKGROUND OF THE INVENTION

The present invention relates generally to protective garments and, more particularly, to an improved, more comfortable, more flexible, protective garment.

Prior to the present invention, technological developments of yarns for protective garments have centered around the use of Kevlar, which is the DuPont trademark for an aramid fiber, as the fiber used in yarns, which yarns are ultimately used in protective garments. By way of example, and not by way of limitation, aramid fibers have been used in yarns with the yarns thereafter knitted to make protective garments including bullet-resistant vests and protective gloves as exemplified by Byrnes, U.S. Pat. No. 3,883,898.

In addition to the use of an aramid yarn as aforesaid, aramid fibers have been utilized in combination with other materials to form a yarn which yarn may be thereafter knitted to form a protective garment such as a protective glove with increased slash or cut resistance. Examples of this concept may be found in Byrnes U.S. Pat. No. 4,004,295, and Byrnes et al. U.S. Pat. No. 4,384,449, each of which describes the use of the Kevlar aramid fiber in combination with wire; the first of these two patents discloses the use of an aramid fiber yarn together with a metal wire and the second of these two patents describes a composite yarn itself; the yarn including a core of aramid fiber plus flexible wire and a covering of aramid fiber.

There are, of course, certain recognized problems with the use of the aramid fiber as the constituent in a yarn to thereafter be utilized in protective garments. For example, aramid fibers weaken in water. Second, the aramid fiber has only a limited resistance to true abrasion. Third, ultraviolet light adversely affects the appearance of the aramid fiber and can cause discolorations in the aramid fiber, discolorations in the yarn and discoloration in the finished product.

Recently, a new high-strength fiber has been announced by Allied Corporation. The fiber is an extended chain polyethylene, which is a polyolefin, and has been sold under the trademark of Spectra with two different fibers being marketed, Spectra 1000 and Spectra 900. We understand that the Spectra 1000 is a 1200 denier fiber and that Spectra 900 is 650 denier fiber.

SUMMARY OF THE INVENTION

The present invention provides a new and improved garment made of a yarn which includes a core and a covering and where the core includes at least one wire strand and one polyolefin-polyethylene strand. The covering may be a polyolefin-polyethylene strand or a nylon strand.

The yarn and garment according to the present invention has numerous substantial advantages over the prior art, commercially available yarns such as those made of the Kevlar aramid fiber. For example, the polyethylene fiber has approximately 50 to 75% greater tensile strength than a comparable aramid fiber. The polyethylene fiber is resistant to ultraviolet light and thus does not result in undesirable color change when the fiber, or yarn made from the fiber, or finished product, are exposed to ultraviolet light. The fiber is inert, non-absorptive, non-allergenic and stable. The density of the Spectra 900 polyethylene fiber is, by way of example, only two-thirds the density of Kevlar 49 aramid fiber. Nonetheless, the polyethylene fiber has a substantially increased tensile strength, resistance to elongation, a substantially increased abrasion resistance, and maintains greater flexibility despite the increases in strength. The fiber has a specific gravity of 1.0 or less, typically 0.97. Thus the garment is stronger, mere flexible and yet mere comfortable.

BRIEF DESCRIPTION OF THE DRAWINGS

The various benefits and advantages of the present invention will be more easily understood upon reading the following detailed description of the invention taken in conjunction with the drawings.

In the drawings, wherein like reference numerals identify corresponding components.

DETAILED DESCRIPTION OF THE INVENTION

Figure 1:
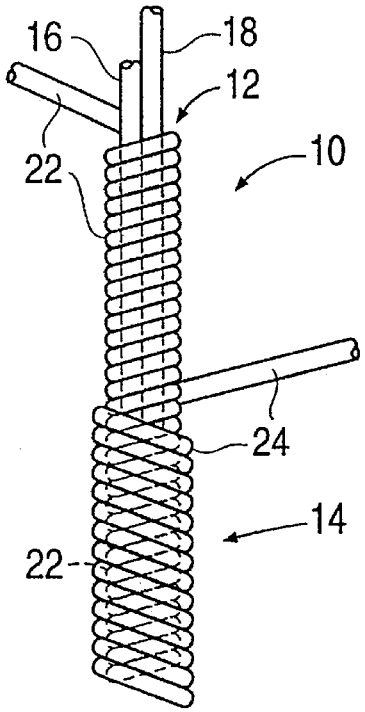
FIG. 1 is an illustration of yarn used in accordance with the principles of the present invention.

With reference to the drawings, the improved yarn 10 used in the present invention is illustrated in a first embodiment in FIG. 1 as being formed of a core 12 and a covering 14. The core 12 includes two substantially parallel strands; one strand 16 is formed of wire such as filament grade 304 stainless steel wire. The second strand 18 in the core is a strand of polyethylene fiber. The two strands are placed parallel to each other.

At this point, it is believed helpful to digress momentarily and provide details of the wire and of the fiber which are included in the core. It should be appreciated that the wire diameter and wire material should be selected based upon the ultimate utilization of the yarn in a protective garment as well as any restrictions based on the capability of the knitting equipment which will be utilized to knit the yarn into the garment. If it is desired to make a cut resistant glove, apron, sleeve or the like for industrial use, there are numerous filament grade wires which may be utilized. The objective, of course, is to minimize the wire diameter, to maximize flexibility, while still maintaining the desired degree of cut resistance and, furthermore, the wire cannot be so thin as to readily break when either knitted into the garment or when the garment is utilized. Of course, if the garment is a protective glove, the flexing of the glove on the hand of the wearer could cause the wire to break if the wire was too thin in diameter or if the wire had insufficient strength.

An additional factor in determining wire diameter is, of course, any limitations imposed by the knitting equipment. There are two conventional glove knitting machines presently on the market, one manufactured by Matuya and the other manufactured by Shima Seiki. With both of these knitting machines, there are limits as to the diameter of the yarn. Since the yarn includes both a core and a covering, the machine thus presents a maximum limit as to the diameter of the wire which may be used. While other knitting machines may, of course, be utilized depending on the nature of the protective garment to be fabricated, the above description sets forth, in general terms, the type of parameters to be evaluated in selecting the desired wire sizes. In addition, of course, the ultimate utilization of the protective garment to be knitted from the yarn of the present invention will, in fact, create additional restrictions. For example, if protective gloves are being knitted from the yarn of the present invention, and if the protective gloves are to used in food handling plants, meat packing facilities and the like, then the wire must be compatible with these needs. By way of example, a stainless steel grade 304 wire having a nominal diameter of 0.0045 inches has been found suitable for use in connection with the polyethylene fibers of the present invention and for knitting the yarn of the present invention into a protective glove for the meat packing industry.

The polyethylene fiber referred to above and manufactured by Allied Corporation has been described by the manufacturer as an extended chain polyethylene with a polyethylene being, of course, a polyolefin. The materials have also been referred to as polyethylene fibers. These materials have also been described as based upon U.S. Pat. No. 4,413,110, issued Nov. 1, 1983. We understand that the term "polyolefin" is a more generic term and "polyethylene" is an example of a class of products which fall within the definition of polyolefins.

One additional aspect of the yarn used in the present invention should be mentioned in connection with the description of the material utilized in the core. When wire is utilized in the core of a yarn, for the purpose of providing cut resistance, it should be appreciated that the wire has relatively low resistance to elongation. It is for this reason that a strand of fiber having a high resistance to elongation is placed parallel to the wire strand within the core. For example, the ultimate elongation of the polyolefin of the present invention is 2.7% which is ten percent better than the aramid fiber.

It is not sufficient, however, to merely provide the parallel strands of wire and fiber; a covering must be provided to hold the core and to protect the user of the garment against breakage of the wire, abrasion from exposed wire and the like. Accordingly, and as suggested in Byrnes et al. U.S. Pat. No. 4,384,449, a covering is provided for the core strands.

Referring back to FIG. 1, the covering 14 is provided in the form of two wraps or strands 22, 24. The covering strands are wrapped with fiber 22 wrapped over the core in a first direction, such as counter-clockwise, and the second fiber 24 wrapped over the first wire and over the core, of course, in the opposite direction. The aforementioned Byrnes et al. patent suggests the need for an aramid fiber as the covering. However, we have discovered that one of the advantages and surprising benefits of the use of the Spectra fibers is that a softer covering may be utilized such as nylon to thus increase the comfort for the wearer of the garment. In this respect, for example, 420, 840 or 1260 denier nylon "Type 6" manufactured by Allied Corporation may be utilized. Alternatively, Nylon 66 may be used. The first or inner wrap may even be wire.

The wrapping of the covering on the core will be further explained. One of many standard types of wire covering machines, such as an Arnold, OMM, Ratti or ACBF may be used. The first or inner wrap holds, protects, covers and cushions the core to protect the core and the user. The second or outer core also serves to protect, cover and cushion. The combination of the dual wrap, one clockwise and the other counterclockwise, further protects and increases cut resistance of the yarn if the yarn is used in a protective garment. The nylon, as is conventional, should be pre-shrunk.

Figure 2:
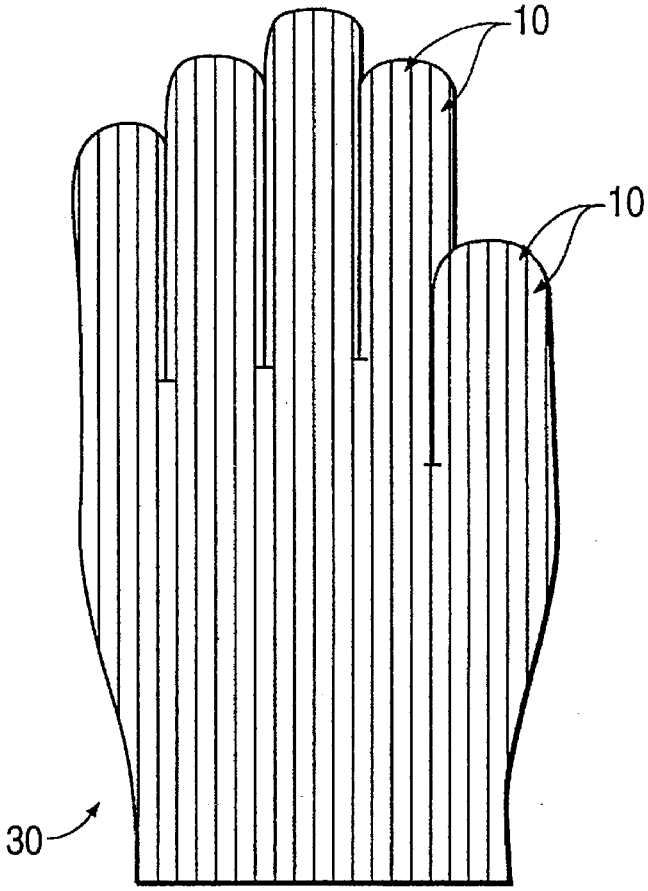
FIG. 2 is an illustration of a protective garment made in accordance with the principles of the present invention.

Referring now to FIG. 2, the yarn as previously described and as set forth more particularly in our co-pending application may be utilized to knit a protective garment such as glove 30. The glove may be knitted on a Matuya or Shima Seiki machine and may be knitted from a single end of yarn. If a heavier duty glove is desired, two ends of yarn may be used in the knitting machine. If a very thin liner is desired, to go underneath a protective glove, a liner of cotton, or nylon, or of the polyolefin fiber itself may also be provided.

Figure 3:
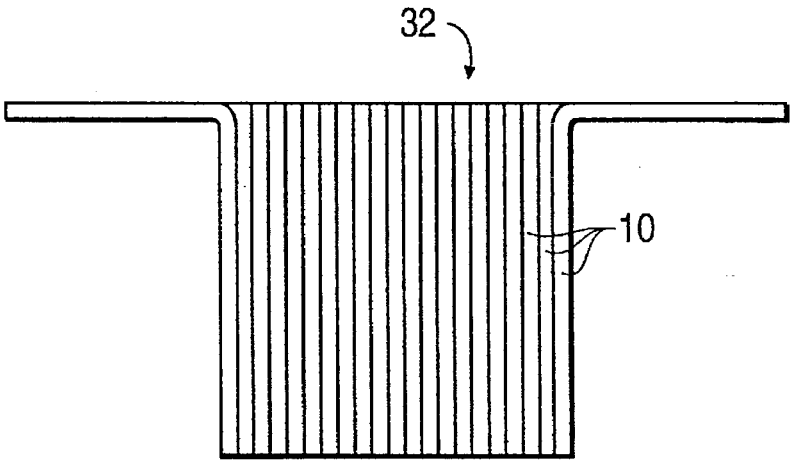
FIG. 3 is an illustration of another protective garment.

In addition to a protective glove, conventional knitting machines other than glove knitting machines may be utilized to knit the yarn into a fabric which may be used for cut-resistant aprons, arm protectors (sleeves), leg and foot protectors, head protection or the like. FIG. 3 illustrates a garment 32 such as a protective apron.

Accordingly, while a preferred utilization of the yarn is for a cut resistant glove for use in meat packing industries or other industrial applications, it should be appreciated that the present invention is not limited solely to gloves.

The foregoing is a complete description of a preferred embodiment of the present invention. Reference should be had to our co-pending application, Ser. No. 06/766,855, filed Aug. 16, 1985, now abandoned, for a further description of the yarn.

What is claimed is:

1. A yarn for use in making strong flexible items, the yarn being essentially aramid free and comprising a core and a covering:

the core including at least one strand of wire and at least one strand of an extended chain polyethylene fiber;

said wire and said polyethylene fiber being positioned parallel to each other; and said covering including at least two strands of fiber wrapped about said parallel positioned core strands, said covering strands being wrapped in opposite directions relative to each other.

2. The invention as defined in claim 1, wherein said covering includes at least one strand of an extended chain polyethylene fiber.

3. The invention as defined in claim 1, wherein said covering includes at least one strand of nylon.

4. The invention as defined in claim 1, wherein said extended chain polyethylene fiber has a specific gravity no greater than the specific gravity of water.

5. The invention as defined in claim 1, wherein the covering includes at least one strand of an extended chain polyethylene fiber.

6. The invention as defined in claim 1, wherein the core wire diameter is approximately 0.0045 inches and the extended chain polyethylene core strand has a denier of between about 600 and about 1300.

7. The invention as defined in claim 6, wherein the covering is formed of nylon having a denier of between about 400 and about 1300.

8. The invention as defined in claim 1, wherein the extended chain polyethylene fiber has an ultimate elongation of less than 3%.

9. A protective garment formed of the yarn of claim 1.

10. A glove formed of the yarn of claim 1.

11. A glove knitted of at least one end of yarn, the yarn being formed according to claim 1.

12. A cut-resistant yarn suitable for machine knitting, comprising a core having at least one strand of flexible metal wire having a diameter between about 0.003 inch and about 0.010 inch and at least one strand of high strength stretched polyethylene fiber having a tensile modulus of at least 500 grams per denier and a denier between 500 and 1200; and at least two wrappings of synthetic fiber wound about the core, at least one of said wrappings also being a high strength stretched polyethylene fiber having a tensile modulus of at least 500 grams per denier.

* * * * *